US011102575B1

(12) United States Patent
Bullimore et al.

(10) Patent No.: US 11,102,575 B1
(45) Date of Patent: Aug. 24, 2021

(54) LOUDSPEAKER WITH PASSIVELY CONTROLLED VOICE COIL SECTIONS

(71) Applicant: TYMPHANY ACOUSTIC TECHNOLOGY LIMITED, Taipei (TW)

(72) Inventors: George Albert Bullimore, Taipei (TW); Ruben Minoru Tuemp Millyard, Taipei (TW)

(73) Assignee: Tymphany Acoustic Technology Limited, Taipei (TW)

( * ) Notice: Subject to any disclaimer, the term of this patent is extended or adjusted under 35 U.S.C. 154(b) by 0 days.

(21) Appl. No.: 16/782,607

(22) Filed: Feb. 5, 2020

(51) Int. Cl.
*H04R 3/00* (2006.01)
*H04R 9/06* (2006.01)
*H04R 9/02* (2006.01)

(52) U.S. Cl.
CPC ..... *H04R 3/00* (2013.01); *H04R 9/025* (2013.01); *H04R 9/06* (2013.01); *H04R 2400/07* (2013.01)

(58) Field of Classification Search
CPC .... H04R 9/025; H04R 2209/041; H04R 3/00; H04R 9/04
USPC ..... 381/401, 162, 117
See application file for complete search history.

(56) References Cited

U.S. PATENT DOCUMENTS 4,566,120 A * 1/1986 Nieuwendijk ..... H04R 3/08 381/117
2005/0031151 A1 2/2005 Melillo
2005/0078848 A1 4/2005 Hlibowicki
2007/0092093 A1* 4/2007 Shim ..... H04R 9/02 381/189
2009/0028374 A1* 1/2009 Hashimoto ..... H04R 9/06 381/401
2016/0142826 A1 5/2016 Honda et al.
2018/0279052 A1 9/2018 Reining
2021/0058725 A1* 2/2021 Millyard ..... G10L 25/21

FOREIGN PATENT DOCUMENTS

| | | | |
|---|---|---|---|
| CN | 86107860 | A | 5/1988 |
| CN | 1886893 | A | 12/2006 |
| CN | 201234340 | Y | 5/2009 |
| CN | 108668198 | A | 10/2018 |
| DE | 10 2010 010 102 | A1 | 9/2011 |
| EP | 3 355 590 | A1 | 8/2018 |
| JP | 2010-124313 | A | 6/2010 |
| KR | 1999 0041875 | A | 6/1999 |

* cited by examiner

*Primary Examiner* — Alexander Krzystan
(74) *Attorney, Agent, or Firm* — Muncy, Geissler, Olds & Lowe, P.C.

(57) ABSTRACT

A method for driving a voice coil of a loudspeaker may include providing a magnetic circuit having an air gap, providing a voice coil suspended in the air gap, and applying an audio signal to the voice coil to move the voice coil along a travelling axis. The voice coil comprises a center voice coil section, an upper voice coil section, and a lower voice coil section arranged on respective sides of the center voice coil section. A center driving signal is provided to the center voice coil and an upper rectified driving signal, attenuating a first direction of current, and a lower rectified driving signal, attenuating a second direction of current, are provided respectively to the upper and lower voice coil sections. The invention further relates to a voice coil driving system and a loudspeaker comprising a voice coil driving system.

23 Claims, 5 Drawing Sheets

LOUDSPEAKER WITH PASSIVELY CONTROLLED VOICE COIL SECTIONS

FIELD OF THE INVENTION

The present invention generally relates to a loudspeaker, and more particularly to a voice coil arrangement that may improve power handling and reduce power consumption of driving electronics.

BACKGROUND

Referring to FIG. 1*a*-1*b*, a voice coil driving system of a conventional loudspeaker is illustrated. The voice coil driving system is equipped with a voice coil 1 comprising a plurality of coil windings. The coil windings are powered by a driving signal 40, such that the voice coil 1 reciprocally actuates the diaphragm 7 to generate an acoustic sound signal.

The coil windings are partially disposed within an air gap 3 of a magnetic circuit 2, the air gap 3 being associated with the greatest magnetic flux density. When the coil windings are powered they interact with the magnetic field of the magnetic circuit 2 to produce an electromotive force translating the voice coil 1. However, only the windings of the voice coil 1 substantially disposed within the gap 3 provide a substantial force to reciprocally translate the voice coil 1. The windings of the voice coil outside the air gap 3 do not significantly interact with the magnetic field of the magnetic circuit 2 and, therefore, do not significantly contribute to the electromotive force for translating the voice coil 1. Nevertheless, the windings disposed outside the air gap 3 are powered and will, as a result, contribute to voice coil heating which can be a major limiting factor in loudspeaker design.

SUMMARY

The presently disclosed embodiments include a loudspeaker design that may address these challenges experienced by conventional loudspeakers. In some cases, the presently disclosed embodiments may reduce the power consumption of the voice coil and may avoid unnecessary voice coil heating, as compared to conventional designs.

One aspect of the invention may include a method for driving a voice coil of a loudspeaker comprising:

providing a magnetic circuit having an air gap and a voice coil suspended in said air gap;

applying an audio signal to said voice coil suspended in said air gap to produce an electromotive force moving said voice coil along a travelling axis;

wherein said voice coil comprises a plurality of voice coil sections, arranged along said travelling axis, said plurality of voice coil sections comprising a center voice coil section, an upper voice coil section and a lower voice coil section, said upper voice coil section and said lower voice coil section arranged respectively on either side of said center voice coil section;

wherein said step of applying an audio signal comprises providing a centerdriving signal based on said audio signal to said center voice coil section and providing an auxiliary driving signal based on said audio signal to said upper voice coil section and said lower voice coil section, said providing an auxiliary driving signal comprising providing an upper rectified driving signal to said upper voice coil section and providing a lower rectified driving signal to said lower voice coil section;

wherein said upper rectified driving signal is provided by attenuating, such as blocking, a first direction of current of said auxiliary driving signal by passive rectification;

wherein said lower rectified driving signal is provided by attenuating, such as blocking, a second direction of current of said auxiliary driving signal by passive rectification; and wherein said first and second direction of current of said auxiliary driving signal are opposite directions of current.

A voice coil may include a coil of wire which under the influence of a magnetic field may generate an electromotive force to move a diaphragm of a loudspeaker in order to produce acoustic sounds. The magnetic field may be established by a magnet, such as a permanent magnet or an electromagnet, present in a magnetic circuit. The magnetic circuit may comprise an air gap in which the voice coil reciprocates to produce acoustic sound by reciprocating the diaphragm of the loudspeaker.

When applying an audio signal, a current is sent to the voice coil windings, in the form of driving signals, e.g. a center driving signal and an auxiliary driving signal, resulting in an electromotive force on the coil windings, due to the magnetic field, which drives the voice coil along a travelling axis which may be substantially perpendicular to the coil windings.

A driving signal provided to a voice coil may comprise current alternating between flowing in a first direction of current and flowing in a second direction of current through the voice coil windings, where the first direction of current and the second direction of current are opposite directions of current. When current flows in a first direction of current through the voice coil windings, an electromotive force may be generated onto the voice coil in a first direction of the travelling axis, and when current flows in a second direction of current through the voice coil windings, an electromotive force may be generated onto the voice coil in a second direction of the travelling axis, where the first direction of the travelling axis and the second direction of the travelling axis are opposite directions along the travelling axis. Thus, forces may be applied to the voice coil in both directions of travel along the travelling axis, which may enable the reciprocation of the voice coil within the air gap.

An audio signal is typically a type of electronic signal. In various embodiments it may be an analog signal, continuous or pulsed. In various embodiments it may be a digital signal. When referring to the amplitude of an audio signal, it may be the amplitude of an analog audio signal, or it may be the audio signal level of a digital audio signal.

Typically, the reciprocating excursion, i.e. reciprocating displacement, of a voice coil in a loudspeaker aims to reproduce the audio signal delivered to the loudspeaker through reciprocations of the diaphragm of the loudspeaker. Thus, an audio signal increasing in amplitude results in an increase of excursion, within the limitations of the loudspeaker. The audio signal may be provided by an external unit such as an audio source arranged to output an electrical audio signal and with connecting means to deliver the audio signal to the loudspeaker. Examples of connecting means may include wired connections such as a cabled electrical or optical connection, and/or wireless connections such as a Bluetooth connection, e.g. Bluetooth A2DP or Bluetooth aptX, or a Wi-Fi connection.

According to various embodiments of the invention, the voice coil may include a plurality of voice coil sections, e.g. comprising an upper voice coil section, a center voice coil section, and a lower voice coil section, but the invention is not restricted to only three sections. Further voice coil sections of the voice coil may be included in other embodiments of the invention.

In an embodiment of the invention said upper voice coil section may include a first auxiliary voice coil section and said lower voice coil section may include second auxiliary voice coil section. In a different embodiment, said lower voice coil section may include a first auxiliary voice coil section and said upper voice coil section may include a second auxiliary voice coil section. An auxiliary voice coil section may include an additional voice coil section which may supplement the center voice coil section in producing an electromotive force reciprocating the voice coil.

A voice coil section may include an individual segment of a voice coil. The voice coil sections may be electrically isolated from each other or may be subsections of a single coil with multiple connections to provide for individual electrical connections to each voice coil section.

In various embodiments, voice coil sections may have the same or different heights, number of windings, density of windings, and comprise windings of the same or different materials. The material of the windings of the voice coil sections may be selected from one or more of alloys, aluminium, silver, copper or gold, or any combinations thereof.

In various embodiments, the voice coil may include an upper voice coil section, a center voice coil section, and a lower voice coil section with the upper voice coil section and the lower voice coil section arranged on either side of the center voice coil section along the direction of the travelling axis. In various embodiments, each of these voice coil sections may have a height of one third of the height of the voice coil. The voice coil sections, however, are not limited to having equal heights or equal number of windings etc. A 'height' of a voice coil in the present disclosure refers to the voice coil's extension along the traveling axis.

Other embodiments may include more than one center voice coil section, more than one upper voice coil section, and/or more than one lower voice coil section. For example, an embodiment may comprise a second upper voice coil section, a first upper voice coil section, a center voice coil section, a first lower voice coil section, and a second lower voice coil section.

To drive the voice coil, a center driving signal, based on the audio signal, may be provided to a center voice coil section, and an auxiliary driving signal, also based on the audio signal, may be provided to an upper voice coil section and a lower voice coil section. Providing the auxiliary driving signal may include providing an upper rectified driving signal to the upper voice coil section and providing a lower rectified driving signal to the lower voice coil section. The upper rectified driving signal may be generated by attenuating or blocking a first direction of current of the auxiliary driving signal, whereas the lower rectified driving signal may be generated by attenuating or blocking a second direction of current of the auxiliary driving signal, opposite to the first direction of current.

The main driving signal and auxiliary driving signal may include in various embodiments the same driving signal or different driving signals. Different driving signals may indicate that the auxiliary driving signal is a representation of said main driving signal but with a lower amplitude than the main driving signal, e.g., having a reduced gain compared to the main driving signal.

In some embodiments, the voice coil sections may be arranged relative to each other and coupled to the driving signals in such a way that the currents flow in the same way in all active voice coil sections so as to support each other in interacting with the magnetic circuit to achieve the electromotive force.

In various embodiments, when current of an auxiliary driving signal flows in a first direction of current, this current may substantially flow to the lower voice coil section, whereas its flow to the upper voice coil section may be attenuated or blocked. Similarly, when current of an auxiliary driving signal flows in a second direction of current, this current may substantially flow to the upper voice coil section, whereas its flow to the lower voice coil section may be attenuated or blocked. The upper rectified driving signal and lower rectified driving signals may be arranged to provide current flowing in an appropriate direction of current to produce an electromotive force on the voice coil such that the audio signal is correctly reproduced.

Alternatively, the flow of current may be reversed such that current flowing in the first direction of current may substantially flow to the upper voice coil section and its flow to the lower voice coil section may be attenuated or blocked. Similarly, as current of an auxiliary driving signal flows in a second direction of current, this current may substantially flow to the lower voice coil section, whereas its flow to the upper voice coil section may be attenuated or blocked. The upper rectified driving signal and lower rectified driving signals may be arranged to provide current flowing in an appropriate direction of current to produce an electromotive force on the voice coil such that the audio signal is correctly reproduced.

An attenuation of a current may be understood as a reduction of current and/or voltage of the signal, e.g. an upper rectified driving signal may be generated by attenuating a first direction of current of an auxiliary driving signal, and thus the magnitude of current flow in a first direction of current in the upper rectified driving signal may be smaller than the magnitude of current flow in a first direction of current in the auxiliary driving signal. Attenuation may preferably include a reduction of current and/or voltage of at least 50%, such as at least 75%, for example at least 90%, or even at least 99%.

Blocking a current may include a reduction of current, such that no substantial current flows after blocking the current.

The attenuation or blocking of the auxiliary signal may be achieved by passive rectification, including attenuation or blocking of one direction of current by passive means, e.g., without requiring active control. As such, passive rectifications may not require a control signal or a power source, besides a driving signal. Passive rectification may for example be achieved by diodes or other non-active components, or circuits thereof. In various embodiments, the upper rectified driving signal may be created by passing the auxiliary driving signal through a rectifying unit, e.g. a diode or diode-based circuit. A passive rectifying unit or a rectifying unit may be a unit, device, circuit, or circuit element which processes or affects current asymmetrically. For example, a rectifying unit may respond in a first way to a current in a first direction, and may respond in a second, different way to a current in a second direction different from the first direction.

An example of a rectifying unit may include a diode, which may be characterized by an asymmetric conductance, i.e. low resistance for one direction of current, and higher resistance for the opposite direction of current, within the current and/or voltage limitations of the diode. To create the upper rectified signal, a diode may be integrated to block a first direction of current of the auxiliary driving signal, while allowing passage of a second direction of current of the auxiliary driving signal. Thereby, a first direction of current in the upper voice coil section may be attenuated or blocked by the diode. The above description may similarly apply to the creation of the lower rectified driving signal which may similarly be created by passing the auxiliary driving signal through a rectifying unit, e.g., a diode, to block a second direction of current of the auxiliary driving signal, while allowing passage of a first direction of current of the auxiliary driving signal. Thereby, a second direction of current in the lower voice coil section may be attenuated or blocked by the diode.

In various embodiments, when the voice coil is not driven (e.g., resting in balance with no signal applied), the center voice coil section may be located substantially within the air gap, the upper voice coil section may be located substantially outside the air gap, and the lower voice coil section may be located substantially outside the air gap. If a driving signal is provided to a voice coil section while it is substantially inside the air gap, the generated electromotive force may be greater, as compared to an electromotive force generated by providing the same driving signal to the same voice coil section when it is substantially outside the air gap.

When the voice coil is driven and thus translates along the traveling axis, the voice coil sections may move in and out of the air gap, depending on the direction, amplitude of translation, and geometry of the voice coil sections. Thus, the contribution to the generation of electromotive force from various voice coil sections may vary while the voice coil reciprocates.

For small audio signals, e.g. of low amplitude, which may result in small voice coil excursions, it may primarily be a center voice coil section which is able to generate an electromotive force. For a larger audio signal, e.g. of larger amplitude, a contribution to the generation of an electromotive force from the upper and/or lower voice coil sections may be required to reproduce an audio signal.

In various embodiments, when driving signals have a first direction of current, the voice coil may move in a first direction of the traveling axis. This may cause a voice coil section, e.g. the lower voice coil section, to travel substantially into the air gap, allowing it to contribute to the generation of an electromotive force. Similarly, when driving signals have a second direction of current, the voice coil may move in a second direction along the traveling axis. This may cause a voice coil section, e.g. the upper voice coil section, to travel substantially into the air gap, allowing it to contribute to the generation of an electromotive force. As such, in various embodiments, the upper and lower voice coil sections may be able to contribute to the generation of an electromotive force.

In various embodiments, when the excursion allows the lower voice coil section to contribute substantially to the generation of an electromotive force, the driving signal received by the lower voice coil section may substantially be the auxiliary driving signal. When the excursion is in the opposite direction, e.g., the upper voice coil section may be closer to the air gap than the lower voice coil section, the lower rectified driving signal received by the lower voice coil section may be created by attenuating or blocking the auxiliary driving signal, such that the lower rectified driving signal may provide no substantial current to the lower voice coil section.

Similarly, when the excursion allows the upper voice coil section to contribute substantially to the generation of an electromotive force, the driving signal received by the upper voice coil section may substantially be the auxiliary driving signal. When the excursion is in the opposite direction, e.g., the lower voice coil section is closer to the air gap than the upper voice coil section, the upper rectified driving signal received by the upper voice coil section may be created by attenuating or blocking the auxiliary driving signal, such that the upper rectified driving signal may provide no substantial current to the upper voice coil section.

In some embodiments, the current provided to the voice coil sections of the segmented voice coil may be reduced due to attenuation or blocking of driving signals. It is especially advantageous to block current to voice coil sections which do not contribute in the generation of an electromotive force. In various embodiments, this may be achieved by implementing one or more rectifying units, e.g., including one or more diodes. This allows the excursion to reproduce an audio signal, while the power consumption and excess heating of a loudspeaker may be reduced.

In various embodiments, rectifying units or diodes may additionally block auxiliary driving signals below a certain threshold amplitude or/and current. This can further reduce power consumption and heating when only small excursions are required to reproduce audio signals.

Various embodiments may be built into active loudspeakers, and other embodiments of the invention may be built into passive loudspeakers. An active loudspeaker may include a loudspeaker comprising means of signal amplification, which may require a power source including, e.g. an external power source or a battery. A passive loudspeaker may be understood as a loudspeaker without means of amplification, thus not necessarily requiring a power source.

In passive loudspeaker embodiments, the audio signal, upon which the center driving signal and the auxiliary driving signal is based, may include an amplified signal. The center driving signal and the auxiliary driving signal may even constitute the audio signal.

In conventional loudspeakers, current is typically provided to the entire voice coil, even though significant portions of the voice coil do not contribute to the generation of an electromotive force. This excess current may waste power and may result in heat generation that imposes limitations on a loudspeaker system. This problem has previously been addressed by segmenting a voice coil into voice coil sections in combination with a complicated control of the driving signal provided to the individual voice coil sections, typically requiring complex solutions.

The presently disclosed embodiments provide a simple solution to these problems, especially as compared to conventional systems with segmented voice coils. Instead of a complicated control of individual driving signals, the disclosed embodiments may utilize rectifying units, e.g. diodes, which are arranged in conjunction with voice coil sections. This method may ensure that the power consumption of voice coil sections which are not able to contribute to the generation of an electromotive force is lowered considerably. Since the power consumption may be reduced, the heat generation in the system may also be reduced. Due to the simplicity of the disclosed embodiments, such embodiments may even be suitable for implementation in passive loudspeakers, or in simple active loudspeaker systems that otherwise cannot or would not support a control procedure for a segmented voice coil. Thus, the disclosed embodiments may extend the capacity of a broad range of loudspeaker systems.

According to certain embodiments, the upper rectified driving signal may be provided by rectifying said auxiliary driving signal in said first direction of current and wherein said lower rectified driving signal may be provided by rectifying said auxiliary driving signal in said second direction of current.

A rectification of a signal may include a process of converting a signal which contains both positive and negative parts, into a signal which only contains either positive or negative parts.

According to some embodiments, the rectifying of the auxiliary driving signal may include half-wave rectification.

Half-wave rectification refers to a type of rectification, where one direction of current is allowed to flow, while another direction of current is blocked, e.g. a half-wave rectification of a signal will block either the positive or the negative parts of the signal, while not substantially affecting other parts.

In various embodiments, the upper rectified driving signal may be provided by a first half-wave rectification of the auxiliary driving signal, and the lower rectified driving signal may be provided by a second half-wave rectification of the auxiliary driving signal, where the first half-wave rectification blocks a first direction of current, and the second half wave rectification blocks a second direction of current.

According to the invention, contrary to for example an AC-to-DC converter or a full-wave bridge rectifier, the rectification may not be intended to move the full signal or energy content to the positive or negative domain, but indeed to exclude most or all negative content from, e.g., the lower rectified driving signal, and exclude most or all positive content from, e.g., the upper rectified driving signal. The remaining content may be transferred as unchanged as possible. This may be because the upper and lower voice coil sections driven by these signals (due to the voice coil geometry) may operate effectively only on either the positive or negative signal content, respectively, depending on the geometric configuration.

According to some embodiments, the providing said upper rectified driving signal comprises processing said auxiliary driving signal using an upper rectifying unit and said providing said lower rectified driving signal comprises processing said auxiliary driving signal using a lower rectifying unit.

According to some embodiments, an upper rectified signal may be provided by attenuating or blocking a first direction of current of an auxiliary driving signal. Similarly, a lower rectified signal may be provided by attenuating or blocking a second direction of current of an auxiliary driving signal. The attenuation and/or blocking of an auxiliary driving signal may comprise one or more rectifying units.

A rectifying unit may include a passive rectifying unit.

A rectifying unit may process an auxiliary driving signal by attenuating or blocking one first direction of current and passing the opposite direction of current. In various embodiments, a rectifying unit may process the auxiliary driving signal to create an upper rectified driving signal, and a rectifying unit may process the auxiliary driving signal to create a lower rectified driving signal. The processing of the auxiliary driving signal to create an upper rectified driving signal may include an asymmetric response to the direction of the current, e.g. current in a first direction may be attenuated or blocked, while current in a second direction may be allowed to pass to the upper voice coil section. The processing of the auxiliary driving signal to create a lower rectified signal may involve an opposite asymmetric response, compared to the processing of the auxiliary driving signal to create an upper rectified signal. For example, current in a second direction may be attenuated or blocked, while current in a first direction different from the second direction may be allowed to pass to the lower voice coil section.

In various embodiments, when one or more rectification units may attenuate or block a direction of current, the same direction of current of the auxiliary driving signal may be attenuated or blocked similarly.

The rectifying unit processing the auxiliary driving signal to provide an upper rectified driving signal may be referred to as an upper rectifying unit, and the rectifying unit processing the auxiliary driving signal to provide a lower rectified driving signal may be referred to as a lower rectifying unit.

In various embodiments, the upper rectifying unit and the lower rectifying unit may be constructed from similar or identical components, but may provide opposite processing of the auxiliary driving signal. For example, an upper rectifying unit may block a first direction of current and allow current in a second direction to pass with no substantial attenuation, while a lower rectifying unit may block a second direction of current and allow current in a first direction to pass with no substantial attenuation.

In some embodiments, the upper rectifying unit and the lower rectifying unit may refer to the same unit, device, circuit or circuit element, such that a single rectifying unit may be capable of providing both an upper rectified driving signal and a lower rectified driving signal on the basis of an auxiliary driving signal.

A rectifying unit may have a characteristic voltage and/or current threshold. Below this voltage and/or current threshold, any current supplied to the rectifying unit may be attenuated or blocked. This may also be referred to as forward voltage drop.

In various embodiments, a rectifying unit with a certain threshold current and/or threshold voltage may be integrated. An auxiliary driving signal which has a current and/or voltage lower than the threshold current and/or threshold voltage may be attenuated or blocked by the rectifying unit. For a small audio signal, e.g. low amplitude, sufficient excursion may be produced by the center voice coil section and may not require an electromotive force generated from the upper voice coil section and/or the lower voice coil section to reproduce the audio signal. In this scenario, a rectifying unit may block or attenuate current to the upper voice coil section, and a rectifying unit may block or attenuate current to the lower voice coil section, i.e. block both directions of current in both rectifying units. If an audio signal has an amplitude sufficiently large, such that it may not be correctly reproduced by the excursion generated by a center voice coil section alone, the current of the auxiliary driving signal may be greater than the threshold current and/or threshold voltage of the rectifying unit. This may allow the upper voice coil section and the lower voice coil section to contribute in the generation of an electromotive force, allowing the excursion to reproduce the audio signal, within the limitations of the voice coil.

As such, for small audio signals, e.g. low amplitude, no substantial current may be supplied to the upper voice coil section or the lower voice coil section, which may reduce power consumption and excess heating, as compared to conventional voice coil systems.

In practice, a rectifying unit may include a diode, which may exhibit an asymmetric conductance, i.e. low resistance for one direction of current, and high resistance for the opposite direction of current, within the current and/or voltage limitations of the diode.

A rectification unit may be connected to either connection of a voice coil section.

According to some embodiments, the upper rectifying unit may include a passive rectifying circuit, and/or said lower rectifying unit may include a passive rectifying circuit.

In various embodiments, the upper and lower rectifying units may include one or more circuits arranged to rectify signals.

In some embodiments, the upper rectifying unit and the lower rectifying unit are included in one circuit, such that this one circuit may be capable of providing both an upper rectified driving signal and a lower rectified driving signal on the basis of an auxiliary driving signal.

A passive rectifying circuit may include a circuit which performs rectification by passive means without requiring active control.

According to an embodiment of the invention each of said upper rectifying unit and said lower rectifying unit may include a half-wave rectifier circuit.

A half-wave rectifier circuit may include a circuit attenuating or blocking either the negative or positive half of a time-varying input signal, and transferring the other half substantially without other attenuation than a forward voltage drop over a typical audio application frequency range, e.g. 20 Hz to 20 kHz. A suitable half-wave rectifier circuit may for example comprise a single diode.

In some cases, smoothing or other filtering of the resulting half-wave signal may be avoided, at least in the above-mentioned frequency range, in order to not distort or filter the audio component of the driving signal. Contrary to, for example, an AC-to-DC converter or a full-wave bridge rectifier, the rectification may not move the full signal or energy content to the positive or negative domain, but indeed may exclude most or all negative content from, e.g., the lower rectified driving signal, and exclude most or all positive content from, e.g., the upper rectified driving signal. The remaining content may be transferred as unchanged as possible. This is because the upper and lower voice coil sections driven by these signals (due to the voice coil geometry) may operate effectively only on either the positive or negative signal content, respectively, depending on the geometric configuration.

In some embodiments, none of the upper rectifying unit and the lower rectifying unit include a full-wave rectifier circuit or a full-wave bridge rectifier.

As explained above, the disclosed rectifying unit should not, in most cases, mirror the negative signal content to the positive side of the signal, and vice versa. Therefore, in most cases, the rectifying unit should not comprise for example a diode bridge for full wave rectification.

According to an embodiment of the invention said upper rectifying unit comprises a diode and said lower rectifying unit comprises a diode.

In various embodiments, the upper and lower rectifying units each comprise a diode, e.g., a single diode each, or a number of diodes coupled equivalently to a single diode, e.g. in series or parallel with the same forward direction. A diode may refer to a device characterized by an asymmetric conductance, i.e. low resistance for one direction of current, and high resistance for the opposite direction of current, within the current and/or voltage limitations of the diode. A diode may comprise a piece of semiconductor material. According to the invention, different types of diodes include point-contact diodes, p-n junction diodes, and Schottky diodes, but the disclosed embodiments are not limited to these diode types.

Various diodes may have various characteristics. Diodes typically have two terminals, and within certain characteristic limitations of voltage and/or current, the electrical resistance for current through the diode from one terminal to the other will typically be different from the electrical resistance of a current of the opposite direction. Often, one direction of current through the diode has a large resistance, such that no substantial current may flow in the diode, up to a break-down voltage. Current in the opposite direction through the diode may have a lower resistance.

Often, a certain cut-in voltage across the diode may be required for it to conduct in its direction of low resistance. At a voltage above this cut-in voltage, the diode may have a low resistance and allow substantial current through, and below this cut-in voltage, the diode may not allow substantial current to pass through. The voltage cut-in may also be referred to as forward voltage drop or turn on voltage.

In various embodiments, a diode with a certain cut-in voltage may be selected, such that below this cut-in voltage, no substantial current passes through the diode. For a small audio signal, e.g. low amplitude, an excursion may not require electromotive force generated from the upper voice coil section and/or the lower voice coil section to reproduce the audio signal. In such an embodiment, a diode may be included that has a cut-in voltage that does not allow substantial current through for voltages of the auxiliary driving signal which corresponds to excursions which can be generated by only using a center voice coil section. That is, if an audio signal has an amplitude that may be reproduced by the excursion generated by a center voice coil section, the voltage of the driving signal may be smaller than the cut-in voltage of the selected diode. If an audio signal has an amplitude sufficiently large, such that it may not be reproduced by the excursion generated by a center voice coil section, the voltage of the driving signal may be greater than the cut-in voltage of the selected diode. This allows the upper voice coil section and the lower voice coil section to contribute in the generation of an electromotive force, allowing the excursion to reproduce the audio signal, within the limitations of the voice coil.

As such, for small audio signals, e.g. low amplitude, no substantial current may be supplied to the upper voice coil section or the lower voice coil section, which may reduce power consumption and excess heating of the loudspeaker system, as compared to conventional systems.

This behavior may allow a diode to be utilized as a rectifying unit.

A diode may allow a reverse current. A reverse current may be understood as a current which can flow through the diode in the direction of current which is characterized by a high resistance. The reverse current may often be smaller than the current of an auxiliary driving signal. Thus, even though a diode may allow a reverse current, for most practical embodiments, the reverse current is not significant.

According to some embodiments, diodes may be coupled with forward voltage drop compensation.

In embodiments using diodes to achieve rectification, and where a forward voltage drop is not desired, the forward voltage drop may be compensated. For example, the compensation may comprise forward biasing the diodes with a DC voltage slightly lower than the intrinsic forward voltage drop of the diodes, e.g. a DC voltage of 0.6V for e.g. silicon diodes with a turn on voltage of 0.7V, or 0.25V for germanium or Schottky diodes with turn on voltage of 0.30V. The auxiliary driving signal may alternatively be offset by similar amounts to compensate the forward voltage drop.

In other embodiments, the forward voltage drop may be desirable as described above, and no compensation needs to be applied. In an embodiment, negative compensation may even be applied to increase the forward voltage drop to require larger signal to overcome the cut-in voltage, thereby allowing selecting a desired voltage at which the rectified auxiliary driving signal is passed through the diode to the auxiliary voice coil sections.

According to an embodiment of the invention said center driving signal and said auxiliary driving signal may be provided by one or more amplifiers.

Generating a driving signal for a voice coil may involve an amplifier. For example, a center driving signal may be provided by an amplifier. Additionally, an auxiliary driving signal may be provided by an amplifier.

One or more amplifiers included in embodiments of the invention may include a common amplifier.

In various embodiments, the amplifier providing an auxiliary driving signal and the amplifier providing the center driving signal may be the same amplifier.

According to an embodiment of the invention, providing an upper rectified driving signal may include amplifying said auxiliary driving signal and providing a lower rectified driving signal may include amplifying said auxiliary driving signal.

In various embodiments, providing the upper and lower rectified signals may involve amplifiers. Such amplifiers may be controlled selectively to generate the rectified driving signals on the basis of the auxiliary driving signal. In other cases, the amplifiers are not controlled selectively.

According to an embodiment of the invention said auxiliary driving signal may have an amplitude different from said center driving signal.

The individual voice coil sections of a segmented voice coil may have different geometries, e.g. different numbers of windings, winding densities, voice coil section heights etc. Therefore, it may be advantageous for the auxiliary driving signal to have a signal amplitude which is different from the amplitude of the center driving signal. In various embodiments, the relative amplitudes may be selected to provide a linear response of the voice coil to an applied audio signal.

According to an embodiment of the invention, said auxiliary driving signal may have the same amplitude as said center driving signal.

The individual voice coil sections of a' segmented voice coil may have the same geometries, e.g. same number of windings, winding densities, voice coil section heights etc. Therefore, it may be advantageous for the auxiliary driving signal to have a signal amplitude which is the same as the amplitude of the center driving signal. In various embodiments, the amplitudes may be selected to ensure a linear response of the voice coil to an applied audio signal.

According to an embodiment of the invention said upper voice coil section may include a first upper voice coil section, said lower voice coil section may include a first lower voice coil section, said upper rectified signal may include a first upper rectified signal, said lower rectified signal may include a second lower rectified signal and said auxiliary driving signal may include a first auxiliary driving signal;

wherein said plurality of voice coil sections arranged along said travelling axis further comprises a second upper voice coil section and a second lower voice coil section, said second upper voice coil section and said second lower voice coil section arranged respectively on either side of the group of voice coil sections comprising said first upper voice coil section, said center voice coil section, and said first lower voice coil section;

wherein said step of applying an audio signal further comprises providing a second auxiliary, driving signal based on said audio signal to said second upper voice coil section and said second lower voice coil section, said providing a second auxiliary driving signal comprising providing a second upper rectified driving signal to said second upper voice coil section and providing a second lower rectified driving signal to said second lower voice coil section;

wherein said second upper rectified driving signal is provided by attenuating, such as blocking, a first direction of current of said second auxiliary driving signal by passive rectification; and wherein said second lower rectified driving signal is provided by attenuating, such as blocking, a second direction of current of said second auxiliary driving signal by passive rectification.

In various embodiments of the invention, the voice coil may include a center voice coil section, a first upper voice coil section, a first lower voice coil section, a second upper voice coil section, and a second lower voice coil section. In some cases, all voice coil sections may be arranged along the travelling axis. The first upper voice coil section and the first lower voice coil section may be arranged around the center voice coil section. The second upper voice coil section and the second lower voice coil section may be arranged respectively on either side of the group of voice coil sections comprising the first upper voice coil section, the center voice coil section, and the first lower voice coil section. The second upper voice coil section may have the first upper voice coil section as the nearest neighboring voice coil section, and the second lower voice coil section may have the first lower voice coil section as the nearest neighboring voice coil section.

When an audio signal is applied, a center driving signal may be provided to the center voice coil section, a first auxiliary driving signal may be provided to the first upper voice coil section and first lower voice coil section, and a second auxiliary driving signal may be provided to the second upper voice coil section and second lower voice coil section. Providing the first auxiliary driving signal may include generating a first upper rectified driving signal using a rectifying unit and generating a first lower rectified driving signal using a rectifying unit. Furthermore, providing the second auxiliary driving signal may include generating a second upper rectified driving signal using a rectifying unit and generating a second lower rectified driving signal using a rectifying unit.

A first upper rectified driving signal may be created based on attenuating or blocking a first direction of current of the first auxiliary driving signal using a rectifying unit, a first lower rectified driving signal may be created based on attenuating or blocking a second direction of current of the first auxiliary driving signal using a rectifying unit, a second upper rectified driving signal may be created based on attenuating or blocking a first direction of current of the second auxiliary driving signal using a rectifying unit, and a second lower rectified driving signal may be created based on attenuating or blocking a second direction of current of the second auxiliary driving using a rectifying unit.

In various embodiments, the rectification units may not be the same, e.g. a first type of rectification unit may be responsible for providing the first upper rectified driving signal and the first lower rectified driving signal, while a second type of rectification unit may be responsible for providing the second upper rectified driving signal and the second lower rectified driving signal.

In some embodiments, the one or more rectifying units generating the first upper rectified driving signal and the first lower rectified driving signal may have a first current and/or voltage threshold, e.g. voltage cut-in level. The one or more rectifying units generating the second upper rectified driving signal and the second lower rectified driving signal may have a second current and/or voltage threshold, e.g. voltage cut-in level.

When a first auxiliary driving signal has a current and/or voltage below a first current and/or voltage threshold, the one or more rectifying units generating the first upper rectified driving signal and the first lower rectified driving signal may attenuate or block the current of the first auxiliary driving signal to the first upper voice coil section and attenuate or block the current of the first auxiliary driving signal to the first lower voice coil. When a second auxiliary driving signal has a current and/or voltage below a second current and/or voltage threshold, the one or more rectifying units generating the second upper rectified driving signal and the second lower rectified driving signal may attenuate or block the current of the second auxiliary driving signal to the second upper voice coil section and attenuate or block the current of the second auxiliary driving signal to the second lower voice coil.

The first current and/or voltage threshold and the second current and/or voltage threshold may respectively be chosen such that currents to voice coils outside the excursion range may be attenuated or blocked. In such embodiments, the power consumption and heat generation may be significantly lower than in a prior art loudspeaker not segmented into voice coil sections, while the excursion is still able to reproduce the audio signal.

In these embodiments, the center driving signal, the first auxiliary driving signal, and the second auxiliary driving signal may all be the same or may all be different. Additionally, any combination of two of the driving signals may be the same, with a third driving signal being different.

In an embodiment of the invention, said first upper voice coil section may include a first inner auxiliary voice coil section, said second upper voice coil section may include an first outer auxiliary voice coil section, said first lower voice coil section may include a second inner auxiliary voice coil section, and said second lower voice coil section may include an second outer auxiliary voice coil section. In a different embodiment, said first lower voice coil section may include a first inner auxiliary voice coil section, said second lower voice coil section may include an first outer auxiliary voice coil section, said first upper voice coil section may include a second inner auxiliary voice coil section, and said second upper voice coil section may include an second outer auxiliary voice coil section.

According to an embodiment of the invention, said upper voice coil section may be displaced with respect to the center voice coil section along a first displacement direction along said travelling axis, said lower voice coil section may be displaced with respect to the center voice coil section along a second displacement direction along said travelling axis, and said upper voice coil section and said lower voice coil section may be arranged symmetrically around said center voice coil section, wherein said first displacement direction and said second displacement direction are opposite directions along said travelling axis.

In various embodiments, at least one upper voice coil section and at least one lower voice coil section may be arranged around a central main voice coil section. Since it may be desirable to have a linear response of the voice coil, it is often advantageous to distribute each individual pair of auxiliary voice coils symmetrically along the axis of translation, relative to a central main voice coil section. The plane of symmetry may be defined by a main voice coil section and may be perpendicular to the axis of translation.

In various embodiments, at least a second upper voice coil section and a second lower voice coil section may be arranged around a central main voice coil section, in addition to a first upper voice coil section and a first lower voice coil section arranged around a central main voice coil section. Since it may be desirable to have a linear response of the voice coil, it is often advantageous to distribute the first upper voice coil section and the first lower voice coil section symmetrically along the axis of translation, relative to a central main voice coil section. The plane of symmetry may be defined by a main voice coil section and may be perpendicular to the axis of translation. Similarly, it is often advantageous to distribute the second upper voice coil section and the second lower voice coil section symmetrically along the axis of translation, relative to a central main voice coil section.

According to an embodiment of the invention, the height of said voice coil sections individually may either be smaller, greater and/or of the same height as the height of said air gap along said travelling axis.

Conventional loudspeakers include both voice coils of heights greater than the height of the air gap along the travelling axis, and voice coils of heights smaller than the height of the air gap along the travelling axis. The height of the air gap according to the disclosed embodiments refers to the extension of the air gap along the traveling axis, and not to the narrow distance between the magnet or pole parts forming the air gap. A voice coil which has a height greater than the height of the air gap along the travelling axis may be referred to as an overhung coil, whereas a voice coil which has a height smaller than the height of the air gap along the travelling axis may be referred to as an underhung coil. The design and geometry may be based on the intended application of the voice coil system.

The present invention may be applicable in embodiments where the height of individual voice coil sections is smaller than the height of the air gap along the travelling axis, as well as in embodiments where the height of individual voice coil sections is greater than the height of the air gap along the travelling axis.

The invention may furthermore be applicable in embodiments where the combined height of the individual voice coil sections is smaller than the height of the air gap along the travelling axis, as well as embodiments where the combined height of the individual voice coil sections is greater than the height of the air gap along the travelling axis.

Additionally, the invention may be applicable in embodiments where the height of individual voice coil sections is the same height as the air gap along the travelling axis, as well as in embodiments where the combined height of the individual voice coil sections is the same height as the air gap along the travelling axis.

Furthermore, the invention may be applicable in embodiments where the height of any of the voice coil sections is individually smaller, greater, and/or of the same height as the height of the air gap along the travelling axis.

An aspect of the invention may relate to a voice coil driving system of a loudspeaker comprising:

a magnetic circuit having an air gap;

a voice coil suspended in said air gap, said voice coil comprising a plurality of voice coil sections, arranged along said travelling axis, said plurality of voice coil sections comprising a center voice coil section, an upper voice coil section and a lower voice coil section, said upper voice coil section and said lower voice coil section being arranged respectively on either side of said center voice coil section;

one or more passive rectifying units arranged to provide an upper rectified driving signal to said upper voice coil section and a lower rectified driving signal to said lower voice coil section.

The method for driving a voice coil may be used in a voice coil driving system of a loudspeaker. As such, the integrated rectifying units may ensure that a reduced amount of current is supplied to selected voice coil sections, when these sections are not able to contribute to the generation of a substantial electromotive force.

In conventional voice coil systems, a current is often provided to the entire voice coil, even though significant portions of the voice coil do not contribute to the generation of an electromotive force, which may result in a waste of power and may result in heat generation that imposes limitations on a voice coil system. The disclosed embodiments may ensure that the heat generation and power consumption of voice coil sections which are not able to contribute to generate an electromotive force are lowered.

According to an embodiment of the invention, one or more passive rectifying units may comprise one or more rectifying circuits.

According to an embodiment of the invention, one or more passive rectifying units may comprise one or more diodes.

The rectifying units may comprise one or more diodes, where a diode may block a first direction of current to the upper voice coil sections, and a diode may block a second direction of current to the lower voice coil sections.

According to an embodiment of the invention, the voice coil driving system may be arranged to receive an audio signal and provide a center driving signal based on said audio signal to said center voice coil section, and provide an auxiliary driving signal based on said audio signal to said one or more passive rectifying units.

In an embodiment of the invention, a center driving signal and an auxiliary driving signal may be generated based on said audio signal, e.g. by amplification of the audio signal. In other various embodiments, the audio signal may include the center driving signal and the auxiliary driving signal.

According to an embodiment of the invention, the voice coil driving system may include two passive rectifying units, each of the two passive rectifying units may be arranged to provide respectively either an upper rectified driving signal or a lower rectified driving signal based on said auxiliary driving signal.

According to an embodiment of the invention, an upper rectifying unit of said one or more passive rectifying units may be arranged to process said auxiliary driving signal by attenuating, such as blocking, a first direction of current of said auxiliary driving signal to provide said upper rectified driving signal; wherein a lower rectifying unit of said one or more passive rectifying units may be arranged to process said auxiliary driving signal by attenuating, such as blocking, a second direction of current of said auxiliary driving signal to provide said lower rectified driving signal; and wherein said first and second direction of current of said auxiliary driving signal are opposite directions of current.

A voice coil driving system as described herein may include one or more of the advantages and benefits as described above in relation to the method of driving a voice coil. As such, a loudspeaker according to the present invention may provide the beneficial effect of lowered power consumption and reduced heating within the loudspeaker due to the efficiency of the segmented voice coil.

An aspect of the invention relates to a loudspeaker comprising: a diaphragm; an interface configured to receive an audio signal; and a voice coil driving system.

A voice coil driving system according to the invention may be integrated into a loudspeaker.

Various embodiments of the invention may include active loudspeakers, and other various embodiments of the invention may include passive loudspeakers. An active loudspeaker may be understood as a loudspeaker comprising means of signal amplification, which may require a power source, e.g. an external power source or a battery. A passive loudspeaker may include a loudspeaker not comprising means of amplification, thus not necessarily requiring a power source.

According to an embodiment of the invention said loudspeaker may include one or more amplifiers.

According to some embodiments, a loudspeaker may comprise at least one amplifier. An amplifier may amplify an audio signal to generate a center driving signal and/or an auxiliary driving signal, but embodiments of the invention are not limited to this example.

A loudspeaker according to the invention may offer some or all of the same advantages as a voice coil driving system according to the invention. For example, heat generation and power consumption of voice coil sections of the loudspeaker system that are not able to contribute significantly to electromotive force generation may be reduced.

BRIEF DESCRIPTION OF THE DRAWINGS

Various embodiments of the invention will in the following be described with reference to the drawings where.

DETAILED DESCRIPTION

Figure 1A:
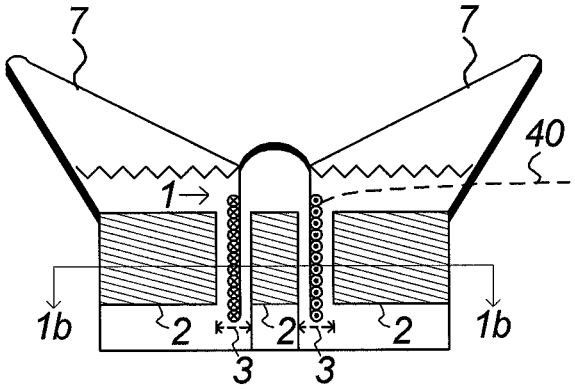
Fig. 1a (prior art)
FIG. 1*a*-1*b* illustrate a conventional loudspeaker design.
Figure 1B:
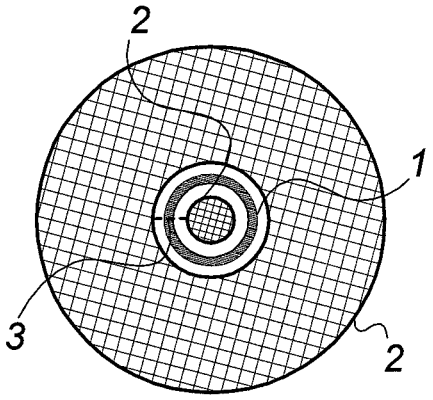
Fig. 1b (prior art)

FIG. 1*a* shows a cut-through view of a conventional loudspeaker. FIG. 1*b* illustrates a section view at the line 1*b*-1*b* in FIG. 1*a*. Disposed within the loudspeaker are two concentrically aligned magnetic members 2 forming a magnetic circuit. These magnetic members 2 may be arranged such that a circular air gap 3 is formed within the magnetic circuit 2.

A voice coil 1 comprising a plurality of coil windings may be further suspended within the air gap 3. The windings of the voice coil 1 may be arranged such that when an electric current is passed through the coil 1, an electromotive force may translate the voice coil 1 within the air gap 3, such that a membrane or diaphragm 7 is actuated. An alternating current may cause a reciprocating movement of the diaphragm 7, which generates an acoustic sound signal.

Figure 2:
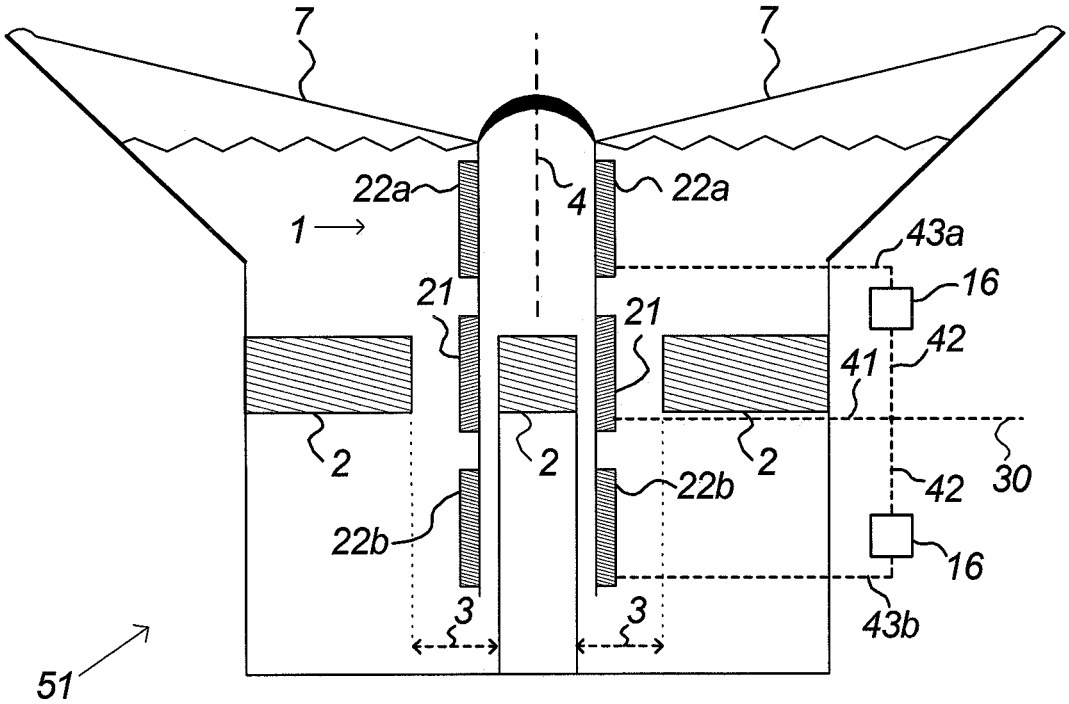
FIG. 2 illustrates a loudspeaker with a voice coil driving system comprising a center voice coil section, an upper voice coil section, and a lower voice coil section according to an embodiment of the invention.

Referring to FIG. 2, a voice coil driving system 51 according to some embodiments of the invention is illustrated. The voice coil driving system 51 comprises a magnetic circuit 2 formed by two concentrically aligned magnetic members 2. The magnetic members may be permanent magnets or metal poles. The magnetic circuit 2 may be arranged such that a circular air gap 3 is formed within the magnetic circuit 2 terminated by the two magnetic members 2. The circular air gap 3 is a volume of air which takes on the form of a volume disposed between two axially aligned cylinders of different widths.

Various alternative voice coil based loudspeaker configurations may be used or incorporated with the principles described herein relative to the disclosed embodiments. For example, such configurations may include variations of magnetic circuits and air gaps, including various configurations of permanent magnets, pole pieces, front and back plates, casing, and various configurations of air gaps, including circular air gaps, as described above, linear, polygonal, irregular, one or several air gaps, etc. The present invention is not limited to the magnetic circuit and air gap configuration illustrated in the drawings but may readily be applied to other voice coil based transducers.

A voice coil 1 may be suspended within the air gap 3. The voice coil 1 comprises a plurality of voice coil sections 21-22*b*, wherein a center voice coil section 21 may be centrally arranged surrounded by an upper voice coil section 21*a* and a lower voice coil section 21*b* arranged respectively on either side of said main voice coil section. The voice coil sections may be axially aligned along a travelling axis 4 of the voice coil 1. Each voice coil section comprises a plurality of metal windings coiling around the inner magnetic member 2 and a travelling axis 4 as seen in FIG. 2. The voice coil sections may be mechanically coupled, but not necessarily electrically coupled, to form the voice coil 1. The mechanical coupling may comprise a support such as a tube, mesh or wire structure of paperboard, plastic or metal, e.g. a foil.

The voice coil sections 21-22*b* may be configured such that when an electric current is passed through a voice coil section 21-22*b*, located at least partly within the air gap 3 of the magnetic circuit 2, an electromotive force may translate the particular voice coil section 21-22*b* along the travelling axis 4. Since voice coil sections 21-22*b* are mechanically coupled members of the voice coil 1, an electromotive force generated by any of voice coil sections 21-22*b* may translate the entire voice coil 1 along the travelling axis 4. The translation of the voice coil 1 along the travelling axis 4 may result in the voice coil 1 pushing and pulling a diaphragm 7 of a loudspeaker 50. The movement of the diaphragm 7 generates an acoustic sound signal.

The coupling of the voice coil 1 and the diaphragm 7 may be established by the above-mentioned mechanical coupling of the voice coil section, e.g. a plastic foil tube, or may involve further support members (e.g., a spider and a diaphragm surround, or other configurations). The idle position of the voice coil 1 may be controlled by the support members, such as a spider and/or a diaphragm surround and frame. The total voice coil height may be centered in the air gap when idle, so that with three voice coil sections, as illustrated in the examples, the middle voice coil section may be aligned with the magnetic circuit and air gap.

Since the magnetic field is substantially disposed within the air gap 3 in the magnetic circuit 2, only voice coil sections 21-22*b* that are at least partly positioned within the air gap may generate a substantive electromotive force upon application of an electric current. Generally, the more of a particular voice coil section is contained within the air gap, the higher the force generated upon electric current application. Referring to the particular arrangement shown in FIG. 2, only voice coil section 21 is fully or partially disposed within the air gap 3, whereas voice coil sections 22*a* and 22*b* are disposed completely outside the air gap 3. Since the magnetic field density is highest within the air gap 3, and quickly decreasing outside the air gap 3, voice coil section 21 may generate a substantial electromotive force to translate the voice coil 1, whereas voice coil sections 22*a* and 22*b* are located sufficiently far away from the air gap 3 that the efficiency in converting electric driving power into electromotive force is considerably lower, and practically insignificant, compared to the efficiency of converting electric driving power into electromotive force for voice coil section 21.

Windings of voice coil sections 21-22*b*, located away from the air gap 3 may contribute to voice coil heating when an electric driving power is applied, but may only contribute marginally in translating the voice coil 1 along the travelling axis 4. Therefore, as described above, it may be advantageous to avoid applying power to voice coil sections 21-22*b*, e.g. 22*a*-22*b*, that are not at least partly disposed within the air gap at a particular time.

Generally, a loudspeaker system aims to reproduce an audio signal 30 in the excursion of a voice coil 1, where the excursion refers to the position of the voice coil 1 relative to its resting position. An audio signal 30 may comprise a representation of varying sound intensities, which may require varying excursions for reproduction. Thus, an audio signal 30 may require a range of excursions which can be established by utilizing the electromotive force which can be generated by the center voice coil section 21, for the audio signal 30 to be reproduced. The reproduction of another audio signal 30 may require a range of excursions which can be established by utilizing the center voice coil section 21 together with the upper voice coil section 22*a* and the lower voice coil section 22*b*.

Referring to FIG. 2, each voice coil section 21-22*b* may receive a driving signal 41, 43*a*-43*b*. These driving signals may be provided by any means, e.g. by a controller, by an amplifier, or by an external source. The center voice coil section 21 may receive a center driving signal 41, the upper voice coil section 22*a* may receive an upper rectified driving signal 43*a*, and the lower voice coil section 22*b* may receive a lower rectified driving signal 43*b*. The upper rectified driving signal 43*a* and the lower rectified driving signal 43*b* may be based on an auxiliary driving signal 42. The auxiliary driving signal 42 and the center driving signal 41 may be based on, or even identical with, the audio signal 30.

The driving signals 41, 43*a*-43*b* may include the actual electric signals that pass through the respective voice coil sections 21-22*b* to generate electromotive force to translate the voice coil 1 along the travelling axis 4. The driving signals 41-43*b* may be provided to the voice coil sections 21-22*b* via channels, e.g. cables or wires, or other electrical connections.

In the exemplary embodiment shown in FIG. 2, the center driving signal 41 and the auxiliary driving signal 42 may include the audio signal 30, but other configurations may be used.

The upper and lower rectified driving signals 43*a*-43*b* may be derived by rectification units 16, based on the auxiliary driving signal 42. A rectifying unit or a passive rectifying unit may process current asymmetrically. For example, a rectifying unit may respond in a first way to a current in a first direction and may respond in a second, different way to a current in a second, different direction.

Preferably, a rectification unit may attenuate or block one direction of current and allow the opposite direction of current to pass.

An example of a rectifying unit 16 may include a diode 17, which may include an asymmetric conductance, i.e. low resistance for one direction of current, and higher resistance for the opposite direction of current, within the current and/or voltage limitations of the diode.

The two rectification units 16 of the exemplary embodiment shown in FIG. 2 may be implemented to block opposite directions of current. As such, when current of an auxiliary driving signal 42 flows in a one direction, this current may substantially flow to the lower voice coil section 22*b*, whereas its flow to the upper voice coil 22*a* section may be blocked. Similarly, when current of an auxiliary driving signal flows in the opposite direction, this current may substantially flow to the upper voice coil section 22*a*, whereas its flow to the lower voice coil section 22*b* may be blocked. This is further described below.

For one direction of driving signal current, the lower voice coil section 22*b*, whose resting position is completely or partly outside the air gap, may be translated towards the air gap, while for the opposite direction of current, it is translated away from the air gap. By implementation of a rectification unit 16, it is possible to attenuate or block current of the auxiliary driving signal 42 to the lower voice coil section 22*b* when it is translated away from the air gap, where it is not able to generate a substantial electromotive force. The same principle applies to upper voice coil section 22*a*, where, for example, the direction in which the current should be attenuated or blocked should be opposite.

Since each direction of current of the driving signals can be related to a certain direction of translation or excursion of the voice coil, depending on the magnetic field orientation, the rectification units may thus be utilized to restrict current to the upper and lower voice sections 22*a*-22*b* when they are translated away from the air gap. Notably, the upper rectified driving signal 43*a* and lower rectified driving signal 43*b* may be arranged to provide current flowing in an appropriate direction of current to produce an electromotive force on the voice coil 1 such that the applied audio signal 30 is correctly reproduced by the excursion of the voice coil.

The voice coil sections 21-22*b* of voice coil 1 may be configured in multiple ways, depending on the relative positioning and dimensioning of the voice coil sections 21-22*b*. In the illustrated embodiments, the voice coil 1 comprises three voice coil sections 21-22*b*, but various other numbers of voice coil sections and voice coil section geometries may be used. For example, in various embodiments, voice coil geometry may be varied, or the number of included voice coils may be increased (e.g., to five voice coil sections). Voice coil configurations including five voice coils may include one center voice coil section, two upper voice coil sections, and two lower voice coil sections, where each of the upper and lower voice coil sections may be connected to different rectification units.

Figure 3A:
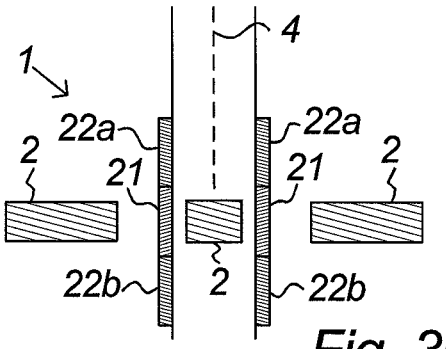
FIG. 3*a*-3*c* illustrate the reciprocating translation of the voice coil according to embodiments of the invention comprising three voice coil sections.
Figure 3B:
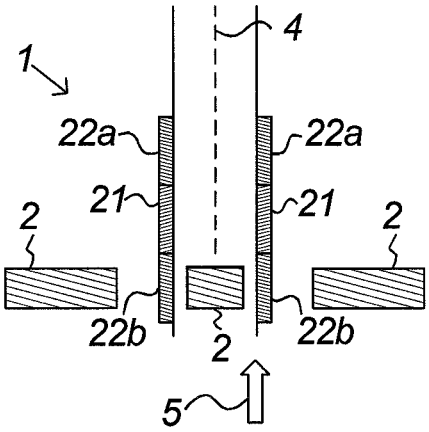
Figure 3C:
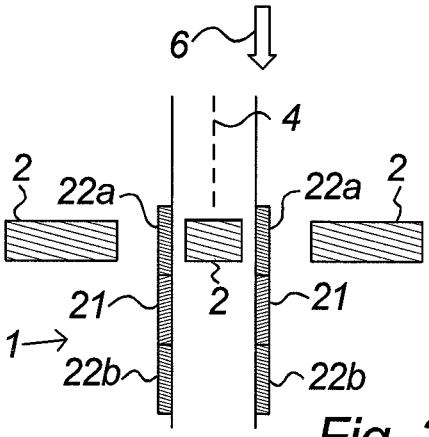

Referring to FIGS. 3*a*-3*c*, the dynamical behavior of the voice coil 1 is illustrated according to some embodiments of the invention.

FIG. 3*a* shows a voice coil 1 comprising a center voice coil section 21, an upper. voice coil section 22*a*, and a lower voice coil section 22*b*, at an instant of time during application of an audio signal. At the represented time, the excursion required to reproduce the audio signal can be generated by the center voice coil section 21 alone. Depending on the direction of current of the auxiliary driving signal 42, current may be attenuated or blocked towards either the upper voice coil section 22*a* or the lower voice coil section 22*b*.

In some embodiments, a current and/or voltage threshold may be implemented such that no current is provided to either the upper voice coil section 22*a* or the lower voice coil section 22*b*, at instances of time similar as that shown in FIG. 3*a*.

In FIG. 3*b*, an audio signal is applied such that the voice coil 1 has been translated in an upward direction 5 at the shown instance of time. As such, the current of the center driving signal 41 and the auxiliary driving signal 42 may have a direction of flow, which is attenuated or blocked towards the upper voice coil section 22*a*.

Alternatively, in FIG. 3*c*, an audio signal is applied such that the voice coil 1 has been translated in a downward direction 6 at the represented instant of time. As such, the current of the center driving signal 41 and the auxiliary driving signal 42 may have a direction of flow, which is attenuated or blocked towards the lower voice coil section 22*b*.

Figure 4A:
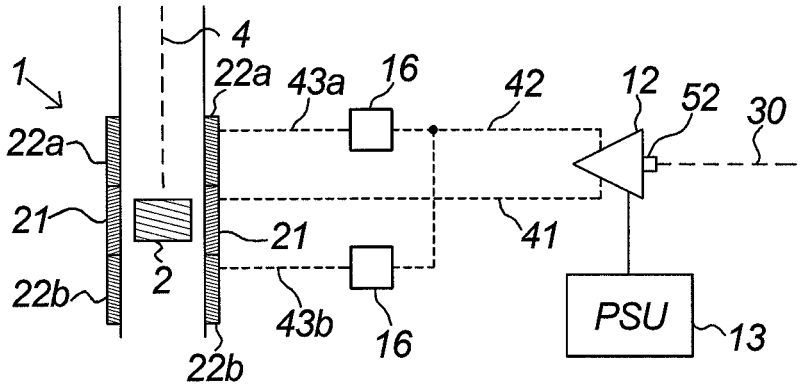
FIG. 4*a*-4*b* illustrate various configurations for providing a center driving signal and an auxiliary driving signal to the plurality of voice coil sections according to embodiments of the invention.
Figure 4B:
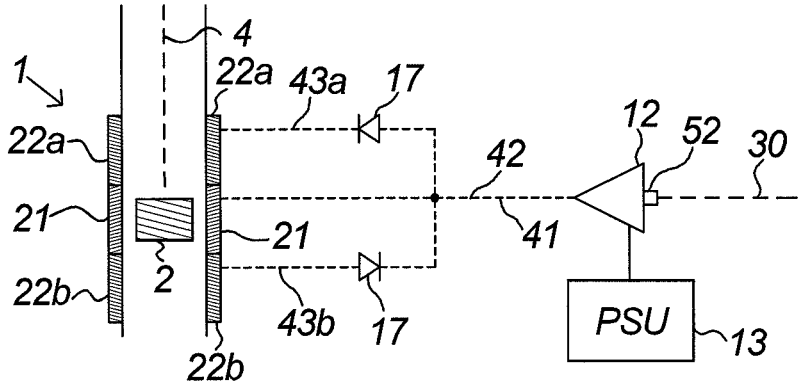

FIGS. 4*a*-4*b* show various embodiments, both including amplification means.

In FIG. 4*a*, an audio signal 30 is provided to an amplifier 12 via an interface 52. The amplifier 12 is powered by a power supply unit 13, e.g. a battery, a DC power supply, or an AC-to-DC power supply. The amplifier 12 has two output channels where the center driving signal 41 and the auxiliary driving signal are provided, respectively. According to the invention, the amplifier 12 may provide two identical amplifications or two different amplifications to provide the two outputs. The center driving signal 41 is sent to the center voice coil section 21, and the auxiliary driving signal 42 is sent to rectification units 16 to generate an upper rectified signal 43*a* and a lower rectified signal 43*b*, which are provided to the upper voice coil section 22*a* and the lower voice coil section 22*b*, respectively.

In FIG. 4*b*, an audio signal 30 is provided to an amplifier 12 via an interface 52, where the amplifier 12 is powered by a power supply unit 13. The amplifier 12 has one output channel, where a signal, which serves as both a center driving signal 41 and an auxiliary driving signal 42, is provided. One channel guides the signal to the center voice coil section 21, and two other channels are attached to diodes 17, which act as rectification units 16 in the embodiment shown. The diodes 17 are attached with opposite directionalities, such that one direction of current is primarily provided to the lower voice coil section 22*b*, while the opposite direction of current is primarily provided to the upper voice coil section 22*a*.

Utilizing one or more diodes 17 in rectification units 16 is not limited to embodiments where an amplifier 12 with one or more output channels is include, as diodes may be used in rectification units included together with any of the disclosed embodiments.

Figure 5:
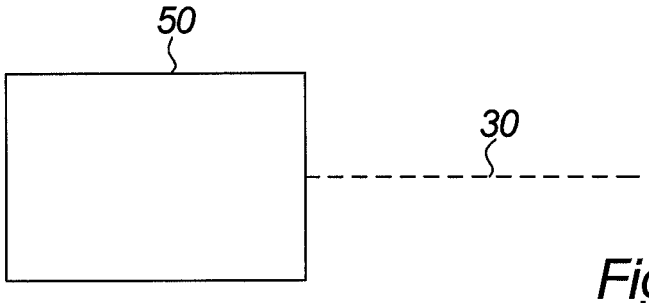
FIG. 5 illustrates a loudspeaker according to an embodiment of the invention.

FIG. 5 represents a loudspeaker 50. The loudspeaker 50 receives an audio signal 30, which is applied to a voice coil driving system 51.

A loudspeaker according to the invention may include a passive loudspeaker which may not require a power source but may include a pre-amplified audio signal, or it may include an active loudspeaker which may include a power source, e.g. for internal amplification for example when receiving a line level or digital audio signal.

Figure 6A:
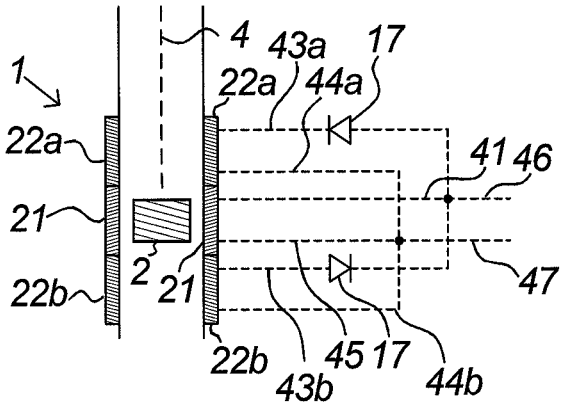
FIG. 6*a*-6*c* illustrate various configurations for applying a center driving signal and an auxiliary driving signal to the plurality of voice coil sections according to the invention.
Figure 6B:
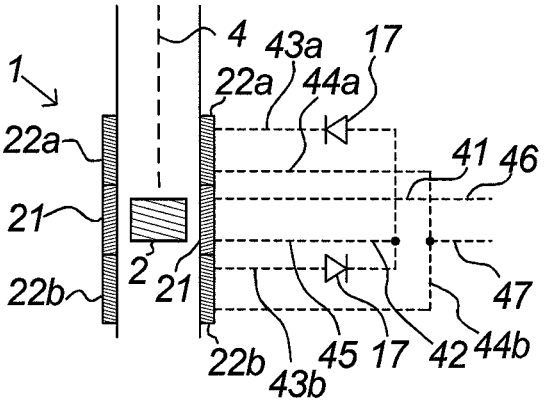
Figure 6C:
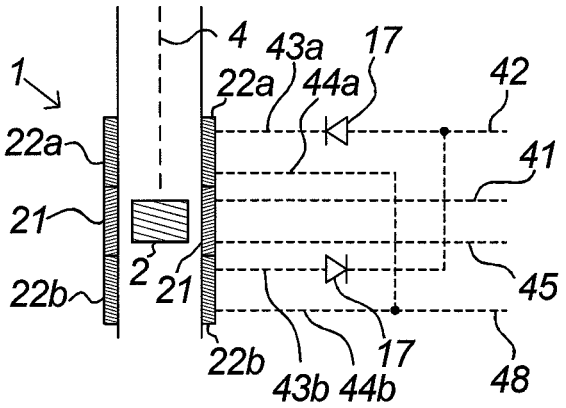

FIGS. 6*a*-6*c* illustrate various configurations of applying the center driving signal 41 and the auxiliary driving signal 42, according to embodiments of the invention.

In FIG. 6*a*, an incoming driving signal 46 is provided to the voice coil 1. This driving signal 46 is provided to the center voice coil section 21 as a center driving signal 41 and provided to two diodes 17 to generate an upper rectified driving signal 43*a* and a lower rectified driving signal 43*b*. The diodes 17 are mounted with opposite directionality, such that the upper rectified driving signal 43*a* and a lower rectified driving signal 43*b* respectively comprise currents flowing in opposite directions. Current delivered to the voice coil sections 21-22*b* are guided out via output channels 44*a*-45. These channels are electrically connected to provide a single current output 47 of the voice coil 1.

In FIG. 6*b*, an incoming driving signal 46 is provided to the voice coil 1. In this case, driving signal 46 is provided only to the center voice coil section 21 as a center driving signal 41. The current of the signal leaves the center voice coil section 21 via an output channel 45. This output channel provides the auxiliary driving signal 42, which is provided to two diodes 17 to generate an upper rectified driving signal 43*a* and a lower rectified driving signal 43*b*. The diodes 17 are mounted with opposite directionality, such that the upper rectified driving signal 43*a* and a lower rectified driving signal 43*b* respectively comprise currents flowing in opposite directions. The current of the upper and lower rectified driving signals 43*a*-43*b*, leaves the upper and lower voice coil sections 22*a*-22*b* through output channels 44*a*-44*b*, which are electrically connected to provide a single current output 47 of the voice coil 1.

In FIG. 6*c*, a center driving signal 41 and an auxiliary driving signal 42 may be provided to the voice coil 1. The center driving signal is provided to the center voice coil section 21, whereas the auxiliary driving signal 42 is provided to two diodes 17 to generate an upper rectified driving signal 43*a* and a lower rectified driving signal 43*b*. The diodes 17 are mounted with opposite directionality, such that the upper rectified driving signal 43*a* and a lower rectified driving signal 43*b* respectively comprise currents flowing in opposite directions.

The current of the center driving signal 41 leaves the center voice coil section 21 through output channel 45, and the current of the upper and lower rectified driving signals 43*a*-43*b*, leaves the upper and lower voice coil sections 22*a*-22*b* through output channels 44*a*-44*b*, which are electrically connected to provide a single auxiliary current output 48.

The embodiments shown in FIGS. 6*a*-6*c* may utilize diodes 17 as rectification units 16, but the disclosed embodiments are not limited to using diodes 17. Furthermore, the disclosed embodiments are examples of providing rectified driving signals through passive rectifications, but other configurations may be used.

Figure 7A:
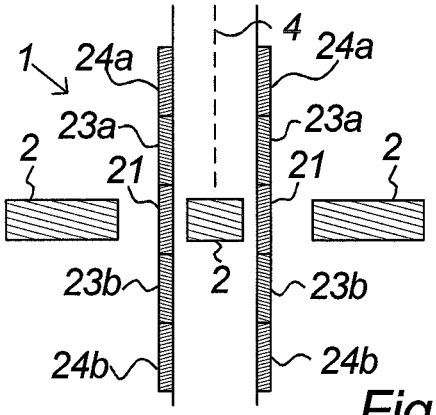
FIG. 7*a*-7*b* illustrate configurations of the voice coil sections according to various embodiments of the invention.

FIG. 7*a* shows an alternative embodiment of the invention with a voice coil 1 comprising five distinct voice coil sections, including a second upper voice coil section 24*a*, a first upper voice coil section 23*a*, a center voice coil section 21, a first lower voice coil section 23*b*, and a second lower voice coil section 24*b*. The upper and lower voice coil sections 23*a*-24*b* may be connected to rectifying units 16 similarly as described in the above with relation to a voice coil 1 comprising an upper voice coil section 22*a* and a lower voice coil section 22*b*. In other words, a voice coil 1 comprising five distinct voice coil sections may comprise, e.g., four rectifying units 16. In this embodiment, four rectifying units 16, such as diodes 17, may be used, however in other embodiments of the invention, fewer rectifying units 16 may be used for a voice coil 1 comprising five distinct voice coil sections. As an example, one or more rectifying circuits, e.g., two rectifying circuits, may be used to provide rectified driving signals to the voice coil section.

As such, when one or more driving signals are provided to the voice coil 1, a first direction of current may be provided to the first lower voice coil section 23*b* and the second lower voice coil section 24*b*, and a second direction of current may be provided to the first upper voice coil section 23*b* and the second upper voice coil section 24*b*.

Rectifying units 16 providing rectified signals to upper and lower voice coil sections 23*a*-24*b* may have different current and/or voltage thresholds. Such thresholds may ensure that current is not provided to voice coil sections when it is not required. As such, when the voice coil sections 24*a*-24*b* are not required to generate an electromotive force to aid in the movement of the voice coil 1, rectification units 16 connected to the outer voice coil sections 24*a*-24*b* may attenuate or block current. Furthermore, when the voice coil sections 23*a*-23*b* are not required to generate an electromotive force to reproduce an applied audio signal, rectifying units 16 connected to the voice coil sections 23*a*-23*b* may attenuate or block current. Current and/or voltage thresholds may be chosen such that the audio signal can be reproduced without distortion within the limitations of the full voice coil 1, while minimal current may be supplied to voice coil sections which are not substantially within the air gap and are therefore not able to generate a significant electromotive force.

Figure 7B:
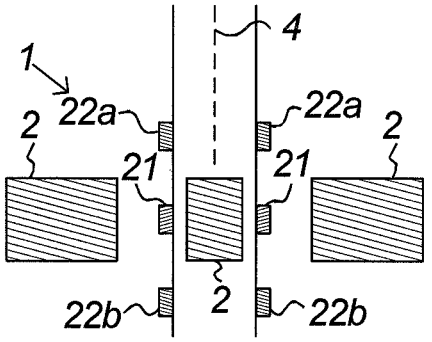

FIG. 7*b* shows another alternative embodiment of the invention, where the height of individual voice coil sections of the voice coil 1 is smaller than the air gap 3 along the direction of the travelling axis 4.

Either the upper voice coil section 22*a* or the lower voice coil section 22*b* may be able to generate an electromotive force to translate the voice coil 1 for very large excursions when the center voice coil section 21 is substantially outside the air gap, i.e. when the center voice coil section 21 leaves the air gap and another voice coil section 22*a*-22*b* enters. In such embodiments, an audio signal 30 may be reproduced by the excursion without distortion, even though the center voice coil section 21 leaves the air gap 3.

Figure 8:
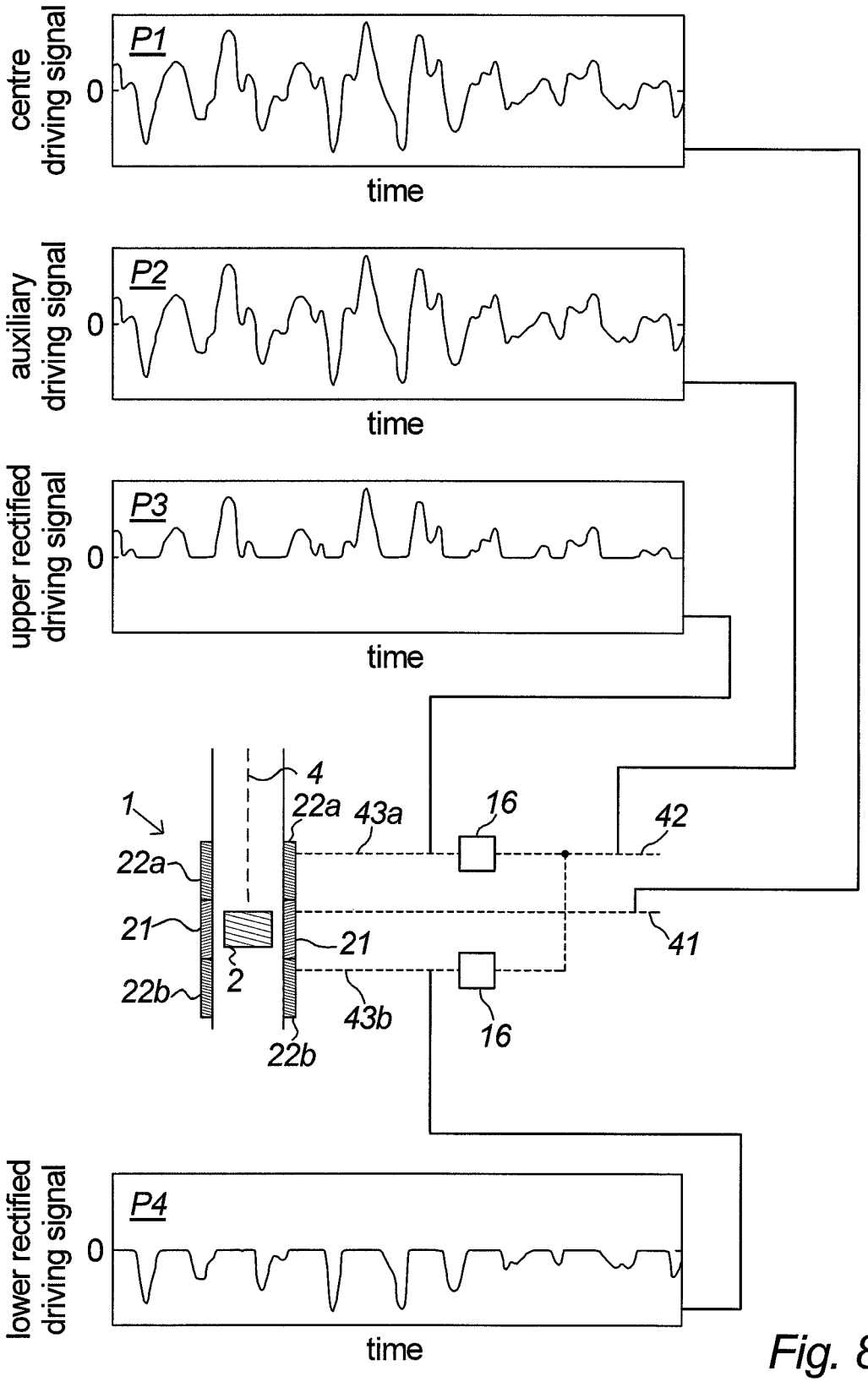
FIG. 8 illustrates a preferred processing of the driving signal according to various embodiments of the invention.

FIG. 8 represents a method of generating an upper rectified driving signal 43*a* and a lower rectified driving signal 43*b* based on an auxiliary driving signal 42.

Four panels P1-P4 display representations of the driving signals at different stages. These representations describe the amplitude of the driving signals as a function of time. The zero point shown on the four panels P1-P4 illustrates points in time of a driving signal where no current flows in respective voice coil sections.

In the exemplary embodiment shown in FIG. 8, a center driving signal 41 is provided to a center voice coil section 21, with a representation of the center driving signal shown in panel P1. Additionally, an auxiliary driving signal 42 is provided, with a representation of the auxiliary driving signal 42 shown in panel P2. In this embodiment the representations of the center driving signal in panel P1 and the auxiliary driving signal in panel P2 are displayed to have similar amplitudes. In various other embodiments, the actual current and/or voltage of the center driving signal and of the auxiliary driving signal may not be the same, i.e. the signals may differ in amplitude/gain, etc.

The auxiliary driving signal 42 may be provided to rectification units 16 to generate an upper rectified driving signal 43*a* and a lower rectified driving signal 43*b*. Thus, as the auxiliary driving signal 42 is provided, a first direction of current may be provided to the lower voice coil section 22*b* and a second, different direction of current may be provided to the upper voice coil section 22*a*. This is illustrated in panel P3 which show a representation of the upper rectified driving signal 43*a* and in panel P4 which show a representation of the lower rectified driving signal 43*b*. In panel P3, negative parts of the signal are absent, whereas in panel P4, positive parts of the signal are absent. In this embodiment, substantially no current of the auxiliary driving signal may be provided to either the upper voice coil section 22*a* or the lower voice coil section 22*b*, depending on the direction of the current.

LIST OF REFERENCE SIGNS

1 Voice coil
2 Magnetic circuit
3 Air gap
4 Travelling axis
5 Upward direction
6 Downward direction
7 Diaphragm
12 Amplifier
13 Power supply unit
16 Rectifying unit
17 Diode
21 Center voice coil section
22*a* Upper voice coil section
22*b* Lower voice coil section
23*a* First upper voice coil section
23*b* First lower voice coil section
24*a* Second upper voice coil section
24*b* Second lower voice coil section
30 Audio signal
40 Driving signal
41 Center driving signal
42 Auxiliary driving signal
43*a* Upper rectified driving signal
43*b* Lower rectified driving signal
44*a* Upper rectified driving signal out
44*b* Lower rectified driving signal out
45 Center driving signal out
46 Driving signal in
47 Driving signal out
48 Auxiliary driving signal out
50 Loudspeaker
51 Voice coil driving system
52 Interface
P1 Panel showing representation of center driving signal
P2 Panel showing representation of auxiliary driving signal
P3 Panel showing representation of upper rectified driving signal
P4 Panel showing representation of lower rectified driving signal

The invention claimed is:

1. A method for driving a voice coil of a loudspeaker comprising:

providing a magnetic circuit having an air gap and a voice coil suspended in said air gap; and applying an audio signal to said voice coil suspended in said air gap to produce an electromotive force moving said voice coil along a travelling axis;

wherein said voice coil comprises a plurality of voice coil sections, arranged along said travelling axis, said plurality of voice coil sections comprising a center voice coil section, an upper voice coil section and a lower voice coil section, said upper voice coil section and said lower voice coil section arranged respectively on either side of said center voice coil section;

wherein said applying said audio signal comprises providing a center driving signal based on said audio signal to said center voice coil section and providing an auxiliary driving signal based on said audio signal to said upper voice coil section and said lower voice coil section, said providing an auxiliary driving signal comprising providing an upper rectified driving signal to said upper voice coil section and providing a lower rectified driving signal to said lower voice coil section;

wherein said upper rectified driving signal is provided by attenuating or blocking, a first direction of current of said auxiliary driving signal by passive rectification;

wherein said lower rectified driving signal is provided by attenuating, such as blocking, a second direction of current of said auxiliary driving signal by passive rectification; and wherein said first and second direction of current of said auxiliary driving signal are opposite directions of current.

2. The method for driving a voice coil according to claim 1, wherein said upper rectified driving signal is provided by rectifying said auxiliary driving signal in said first direction of current and wherein said lower rectified driving signal is provided by rectifying said auxiliary driving signal in said second direction of current.

3. The method for driving a voice coil according to claim 2, wherein said rectifying said auxiliary driving signal is half-wave rectification.

4. The method for driving a voice coil according to claim 1, wherein said providing said upper rectified driving signal comprises processing said auxiliary driving signal using an upper rectifying unit, and said providing said lower rectified driving signal comprises processing said auxiliary driving signal using a lower rectifying unit.

5. The method for driving a voice coil according to claim 4, wherein said upper rectifying unit comprises a passive rectifying circuit, and wherein said lower rectifying unit comprises a passive rectifying circuit.

6. The method for driving a voice coil according to claim 5, wherein each of said upper rectifying unit and said lower rectifying unit comprises a half-wave rectifier circuit.

7. The method for driving a voice coil according to claim 6, wherein neither said upper rectifying unit nor said lower rectifying unit comprises a full-wave rectifier circuit or a full-wave bridge rectifier.

8. The method for driving a voice coil according to claim 6, wherein said upper rectifying unit comprises a diode and wherein said lower rectifying unit comprises a diode.

9. The method for driving a voice coil according to claim 8, wherein said diodes are coupled with forward voltage drop compensation.

10. The method for driving a voice coil according to claim 1, wherein said center driving signal and said auxiliary driving signal are provided by one or more amplifiers.

11. The method for driving a voice coil according to claim 10, wherein said one or more amplifiers is a common amplifier.

12. The method for driving a voice coil according to claim 1, wherein said providing an upper rectified driving signal comprises amplifying said auxiliary driving signal and wherein said providing a lower rectified driving signal comprises amplifying said auxiliary driving signal.

13. The method for driving a voice coil according to claim 1, wherein said auxiliary driving signal has an amplitude different from said center driving signal.

14. The method for driving a voice coil according to claim 1, wherein said auxiliary driving signal has the same amplitude as said center driving signal.

15. The method for driving a voice coil according to claim 1, wherein said upper voice coil section is a first upper voice coil section, said lower voice coil section is a first lower voice coil section, said upper rectified signal is a first upper rectified signal, said lower rectified signal is a second lower rectified signal and said auxiliary driving signal is a first auxiliary driving signal;

wherein said plurality of voice coil sections arranged along said travelling axis further comprises a second upper voice coil section and a second lower voice coil section, said second upper voice coil section and said second lower voice coil section arranged respectively on either side of the group of voice coil sections comprising said first upper voice coil section, said center voice coil section, and said first lower voice coil section;

wherein said step of applying an audio signal further comprises providing a second auxiliary driving signal based on said audio signal to said second upper voice coil section and said second lower voice coil section, said providing a second auxiliary driving signal comprising providing a second upper rectified driving signal to said second upper voice coil section and providing a second lower rectified driving signal to said second lower voice coil section;

wherein said second upper rectified driving signal is provided by attenuating, such as blocking, a first direction of current of said second auxiliary driving signal by passive rectification; and wherein said second lower rectified driving signal is provided by attenuating, such as blocking, a second direction of current of said second auxiliary driving signal by passive rectification.

16. The method for driving a voice coil according to claim 1, wherein said upper voice coil section is displaced with respect to the center voice coil section along a first displacement direction along said travelling axis, said lower voice coil section is displaced with respect to the center voice coil section along a second displacement direction along said travelling axis, and said upper voice coil section and said lower voice coil section are arranged symmetrically around said center voice coil section, wherein said first displacement direction and said second displacement direction are opposite directions along said travelling axis.

17. The method for driving a voice coil according to claim 1, wherein heights of said voice coil sections are individually one or smaller than, greater than, or of the same height as the height of said air gap along said travelling axis.

18. A voice coil driving system of a loudspeaker comprising:

a magnetic circuit having an air gap;

a voice coil suspended in said air gap, said voice coil comprising a plurality of voice coil sections, arranged along said travelling axis, said plurality of voice coil sections comprising a center voice coil section, an upper voice coil section and a lower voice coil section, said upper voice coil section and said lower voice coil section being arranged respectively on either side of said center voice coil section;

two passive rectifying units each arranged to provide respectively either an upper rectified driving signal to said upper voice coil section based on said auxiliary driving signal or a lower rectified driving signal to said lower voice coil section based on said auxiliary driving signal, wherein an upper rectifying unit of said two passive rectifying units is arranged to process said auxiliary driving signal by attenuating or blocking a first direction of current of said auxiliary driving signal to provide said upper rectified driving signal, wherein a lower rectifying unit of said two passive rectifying units is arranged to process said auxiliary driving signal by attenuating, such as blocking, a second direction of current of said auxiliary driving signal to provide said lower rectified driving signal, and wherein said first and second direction of current of said auxiliary driving signal are opposite directions of current.

19. The voice coil driving system according to claim 18, wherein said one or more passive rectifying units comprise one or more rectifying circuits.

20. The voice coil driving system according to claim 19, wherein said one or more passive rectifying units comprise one or more diodes.

21. The voice coil driving system according to claim 18, wherein said voice coil driving system is arranged to receive an audio signal and provide a center driving signal based on said audio signal to said center voice coil section, and provide an auxiliary driving signal based on said audio signal to said one or more passive rectifying units.

22. A loudspeaker comprising a diaphragm; an interface configured to receive an audio signal; and a voice coil driving system according to claim 18.

23. The loudspeaker according to claim 22, wherein said loudspeaker comprises one or more amplifiers.

* * * * *